US010994986B2

(12) United States Patent
Schmidt et al.

(10) Patent No.: US 10,994,986 B2
(45) Date of Patent: May 4, 2021

(54) DISPENSER

(71) Applicant: OBRIST CLOSURES SWITZERLAND GMBH, Reinach (CH)

(72) Inventors: Patrick Schmidt, Zell-Kaimt (DE); Peter Stoelben, Briedel (DE)

(73) Assignee: OBRIST CLOSURES SWITZERLAND GMBH, Reinach (CH)

( * ) Notice: Subject to any disclaimer, the term of this patent is extended or adjusted under 35 U.S.C. 154(b) by 0 days.

(21) Appl. No.: 16/478,131

(22) PCT Filed: Dec. 22, 2017

(86) PCT No.: PCT/EP2017/084450

§ 371 (c)(1),
(2) Date: Jul. 16, 2019

(87) PCT Pub. No.: WO2018/134030

PCT Pub. Date: Jul. 26, 2018

(65) Prior Publication Data

US 2020/0031658 A1 Jan. 30, 2020

Related U.S. Application Data

(60) Provisional application No. 62/447,744, filed on Jan. 18, 2017.

(51) Int. Cl.
*B67D 3/04* (2006.01)

(52) U.S. Cl.
CPC ..... *B67D 3/045* (2013.01)

(58) Field of Classification Search
CPC ..... B67D 3/045
USPC ..... 222/105, 518
See application file for complete search history.

(56) References Cited

U.S. PATENT DOCUMENTS

| | | | | |
|---|---|---|---|---|
| 7,455,281 | B2 * | 11/2008 | Craft | B67D 3/045 251/335.2 |
| 2007/0181615 | A1 * | 8/2007 | Allanson | F16K 23/00 222/518 |
| 2008/0078970 | A1 | 4/2008 | Craft | |
| 2008/0245821 | A1 * | 10/2008 | Itzkowitz | A45D 34/04 222/190 |

(Continued)

FOREIGN PATENT DOCUMENTS

| | | | |
|---|---|---|---|
| GB | 2333288 | A | 7/1999 |
| WO | 01/76978 | A1 | 10/2001 |

(Continued)

OTHER PUBLICATIONS

International Search Report in PCT/EP2017/084450, dated Jun. 19, 2018, 7pp.

*Primary Examiner* — Donnell A Long
(74) *Attorney, Agent, or Firm* — Hauptman Ham, LLP

(57) ABSTRACT

A dispensing tap has a body which is attached or attachable to a container. The body has a dispensing orifice, and a piston movable within the body between a dispensing position in which flowable product can pass through the orifice and a sealing position in which fluid cannot pass through the orifice. The piston has one or more dispensing apertures through which product can pass when the piston is in the dispensing position to reach the dispensing orifice.

21 Claims, 6 Drawing Sheets

(56) References Cited

U.S. PATENT DOCUMENTS

| | | | | |
|---|---|---|---|---|
| 2011/0017782 | A1* | 1/2011 | Nini | B67D 3/044 222/518 |
| 2011/0042420 | A1* | 2/2011 | Totten | B67D 3/043 222/518 |
| 2011/0174842 | A1* | 7/2011 | Nini | F16K 7/16 222/213 |
| 2012/0211519 | A1* | 8/2012 | Hauner | B67D 3/045 222/81 |
| 2016/0326467 | A1* | 11/2016 | Qin | C09B 69/00 |
| 2017/0066641 | A1* | 3/2017 | Van Der Molen | F16K 41/10 |

FOREIGN PATENT DOCUMENTS

| | | | |
|---|---|---|---|
| WO | 2011/162788 | A1 | 12/2011 |
| WO | 2015/142164 | A1 | 9/2015 |

* cited by examiner

DISPENSER

RELATED APPLICATIONS

The present application is a National Phase of International Application Number PCT/EP2017/084450, filed Dec. 22, 2017, and claims priority of U.S. Provisional Application No. 62/447,744, filed Jan. 18, 2017.

FIELD

The present invention relates to a dispensing tap, closure or the like, which can be attached to a container, while such containers are arranged for storing a fluid or another flowable medium, which can be dispensed through a dispensing passage of the dispensing closure.

SUMMARY

According to an aspect of the present invention there is provided a dispensing tap comprising a body which is attached or attachable to a container, the body having a dispensing orifice, and a piston movable within the body between a dispensing position in which flowable product can pass through the orifice and a sealing position in which fluid cannot pass through the orifice, in which the piston comprises one or more dispensing apertures through which product can pass when the piston is in the dispensing position to reach the dispensing orifice.

The tap may comprise a press button for moving the piston between the dispensing and sealing positions.

In some embodiments, in the sealing position the button is generally dome-shape. In other embodiments, in the sealing position the button is generally flat.

The button may formed from a thermoplastic elastomer (TPE) material.

The piston may comprise a stem and a cylindrical sealing wall. The stem may be joined to the wall by a plurality of spokes, said spokes defining a plurality of dispensing apertures therebetween.

A further aspect provides a continuous flow press tap comprising a body which is attached or attachable to a container, the body having a dispensing orifice, and a mobile piston movable within the body between a first position in which product can pass through the orifice and a second position in which it cannot, in which a tubular terminal dispensing conduit extends beyond the orifice, the orifice having a first cross-sectional shape and the conduit has a second cross-sectional shape, the first and second shapes being different from each other.

The first shape may be selected from the group of generally: circular, square, oval, ellipsoidal, triangular or polygonal.

The second shape may be selected from the group of generally: circular, square, oval, ellipsoidal, triangular or polygonal.

In one embodiment the first shape is generally elliptical and the second shape is generally square.

A further aspect provides a dispensing pack comprising a container filled with a flowable product and a dispensing tap attached to the container for controlling flow of product out of the container, in which the flowable product has a viscosity in the range 4.000-6.000 cps at 0.05 $s^{-1}$.

The product may be a laundry care product.

A further aspect provides a dispenser comprising a body which is attached or attachable to a container, the body having a dispensing orifice through which flowable product from the container can be dispensed in use, the body including a product tunnel through which product passes to reach the dispensing orifice, the dispenser further comprising a mobile piston movable within the product tunnel along a path having a piston movement axis between a first position in which product can flow through the orifice in a direction generally orthogonal to the piston movement axis, and a second position in which it cannot, the dispenser further comprising a resilient push button for moving the piston from the second position to the first position, the button being biased to keep the piston in the second position and depressable to move the piston to the first position, in which the piston comprises one or more dispensing apertures through which product can pass when the piston is in the first position to reach the dispensing orifice, and in which a tubular terminal dispensing conduit extends beyond the orifice, the orifice having a first cross-sectional shape and the conduit has a second cross-sectional shape, the first and second shapes being different from each other.

The product tunnel may be generally cylindrical.

The product tunnel may be generally straight.

The product tunnel may have a generally circular section.

The body may be formed as a first part, the piston may be formed as a second part and the button may be formed as a third part.

The body may include a base provided with a screw thread formation.

The tubular terminal dispensing conduit may be oriented approximately orthogonally to the product tunnel.

In some aspects and embodiments the present invention provides a continuous flow press tap.

The present invention also provides a tap/dispenser/closure as described herein in combination with a container.

In some embodiments the tap is designed to work with high/medium high viscous products, for example with a product viscosity in the range: 4.000-6.000 cps at 0.05 s−1.

The present invention also provides for a container in combination with an opening for dosing viscous products in the range of 4.000-6.000 cps at 0.05 s−1.

Different aspects and embodiments of the invention may be used separately or together.

DETAILED DESCRIPTION

Figure 1:
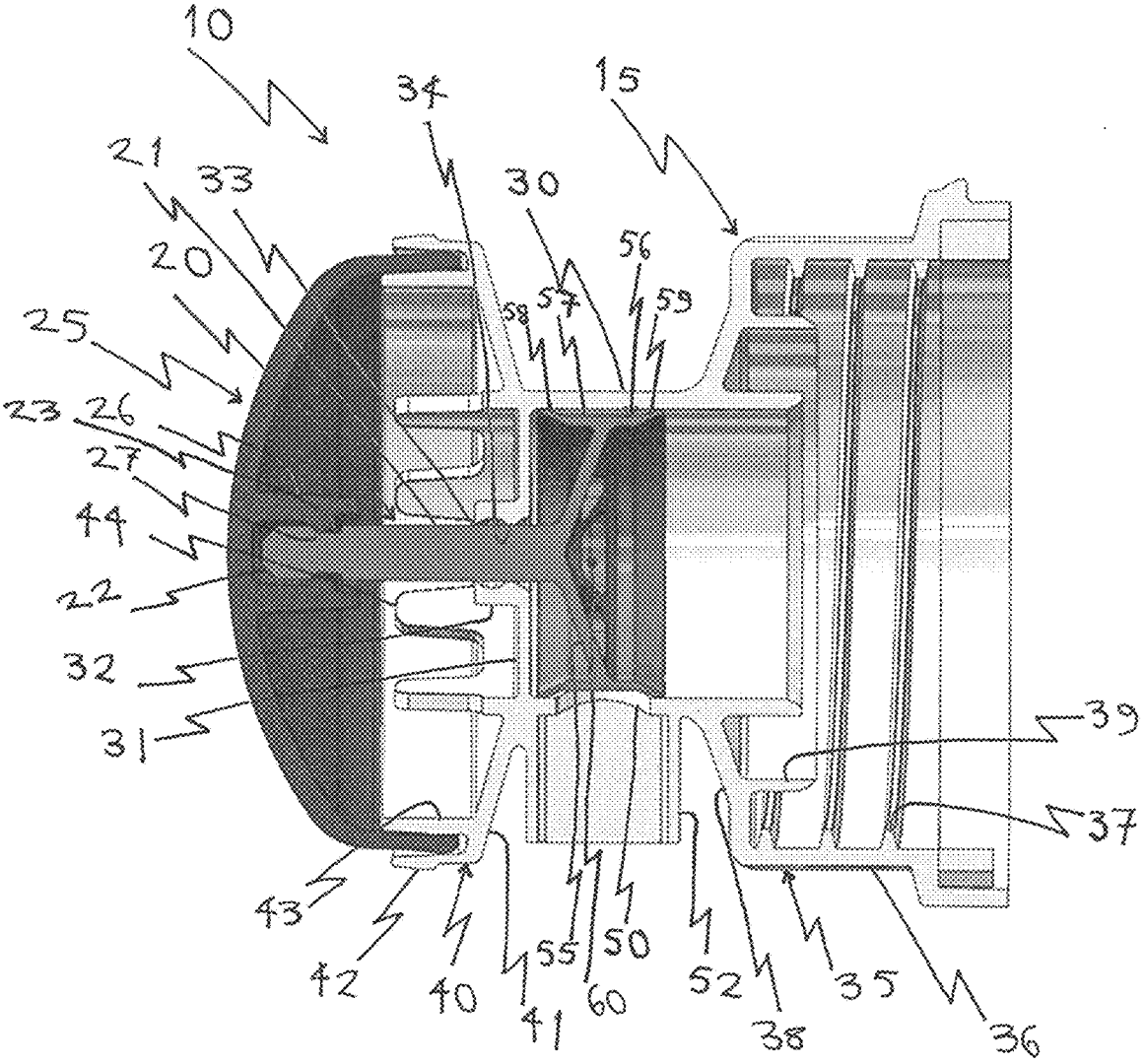
FIG. 1 shows a tap with a button in a relaxed position and a piston in a withdrawn position.

The present invention will now be more particularly described, by way of example, with reference to the accompanying drawings.

In the following description, all orientational terms, such as upper, lower, radially and axially, are used in relation to the drawings and should not be interpreted as limiting on the invention or its connection to a closure.

Example embodiments are described below in sufficient detail to enable those of ordinary skill in the art to embody and implement the systems and processes herein described. It is important to understand that embodiments can be provided in many alternate forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed and as well as individual embodiments the invention is intended to cover combinations of those embodiments as well. On the contrary, all modifications, equivalents, and alternatives falling within the scope of the appended claims should be included. Elements of the example embodiments are consistently denoted by the same reference numerals throughout the drawings and detailed description where appropriate.

The terminology used herein to describe embodiments is not intended to limit the scope. The articles "a," "an," and "the" are singular in that they have a single referent; however, the use of the singular form in the present document should not preclude the presence of more than one referent. In other words, elements referred to in the singular can number one or more, unless the context clearly indicates otherwise. It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof.

Unless otherwise defined, all terms (including technical and scientific terms) used herein are to be interpreted as is customary in the art. It will be further understood that terms in common usage should also be interpreted as is customary in the relevant art and not in an idealized or overly formal sense unless expressly so defined herein.

Referring now to the drawings, there is shown a dispensing tap generally indicated 10.

The tap 10 comprises a body IS, a piston 20 and a press button 25.

The body 15 comprises a central product tunnel 30, a base 35 which extends from one end of the tunnel 30 and a button dock 40 which extends from the other end of the tunnel 30.

The product tunnel 30 is generally cylindrical, being open at the base end, and partially closed at the dock end by a circular end plate 31 with a central annular wall 32 upstanding therefrom to define a central hole 33. The wall 32 includes an internal sealing bead 34.

The tunnel 30 also comprises an elliptical orifice 50 adjacent the plate 31. Extending from the orifice 50 is a terminal dispensing conduit 52 which has a generally square section.

The dock 40 extends from the tunnel 30 and comprises an inclined annular wall 41 from which extends an axial annular wall 42. Slightly radially inwardly of the wall, a further wall 43 extends so as to define an annular channel 43 therebetween. Extending from the periphery of the end plate 31 is a plurality of castellations 44.

The button 25 is generally dome-shape, the periphery of which is shaped so as to fit tightly into the channel 43. The interior of the button 25 is provided with a piston socket in the form of an annular wall 26. The wall 26 includes a retention bead 27 towards the free end thereof. In this embodiment the button 25 is formed from a TPE material.

The piston 20 comprises an elongate stem 21 one end of which includes a head portion 22 with a recess 23. The head portion 22 is shaped and sized so as to be received into the wall 26 so that the bead 27 engages in the recess 23 so that the piston is securely retained.

The stem 21 extends so as to pass through the hole 33. At the end of the stem 21 opposite the head portion 22, a plurality of inclined spokes 55 extend radially outwards and connect approximately half way along a cylindrical sealing wall 56. The spokes 55 are mutually spaced and defined between them are a plurality of dispensing apertures 60.

The sealing wall 56 includes a central portion 57 and a terminal wall portion 58, 59 at either end thereof which are inclined so as to seal against the interior of the tunnel 30.

The base 35 comprises a sidewall 36 with an internal screw thread 37. At one end of the sidewall 36 a kinked annular end plate 38 extends radially inwards and connects to the exterior of the tunnel 30. Around half way along the plate 38 an annular sealing wall 39 depends. The sidewall 36 and the sealing wall 39 are coaxial with the tunnel 30. In use the base 35 can be screwed on a container neck. The wall 39 will sealingly enter into the bore of the neck.

FIG. 1 shows the tap 10 with the button 25 in a relaxed position. In this position the piston 20 is in a withdrawn position. The sealing wall 56 is adjacent the end plate 31 and as such the central portion 57 of the piston sealing wall 56 overlays the orifice 50, with the wall portions 58, 59 positioned sealingly either side of the orifice 30. In this position, therefore, product cannot flow through the orifice 30.

Figure 2:
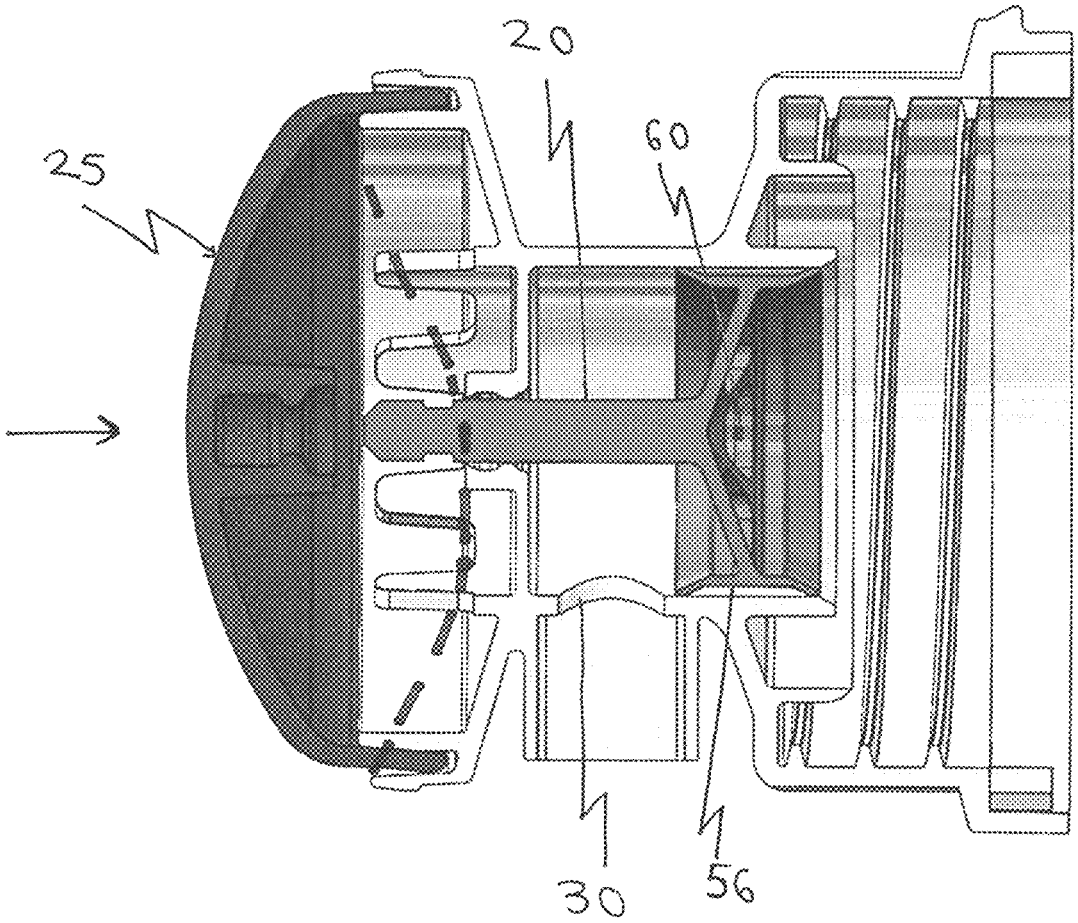
FIG. 2 shows the tap pressed inwards, and the piston moved.

To operate the tap 10 the button 25 is pressed inwards (the castellations 44 act as an end stop for depressing the button) as represented by the dotted line. This causes the piston 20 to move to the position shown in FIG. 2 and as a result the wall 56 is moved away from the orifice 30. Product can now flow through the apertures 60 of the piston 20 so that it can reach the orifice 30.

Product flows out of the orifice 30 and then through the dispensing conduit 52.

Figure 3:
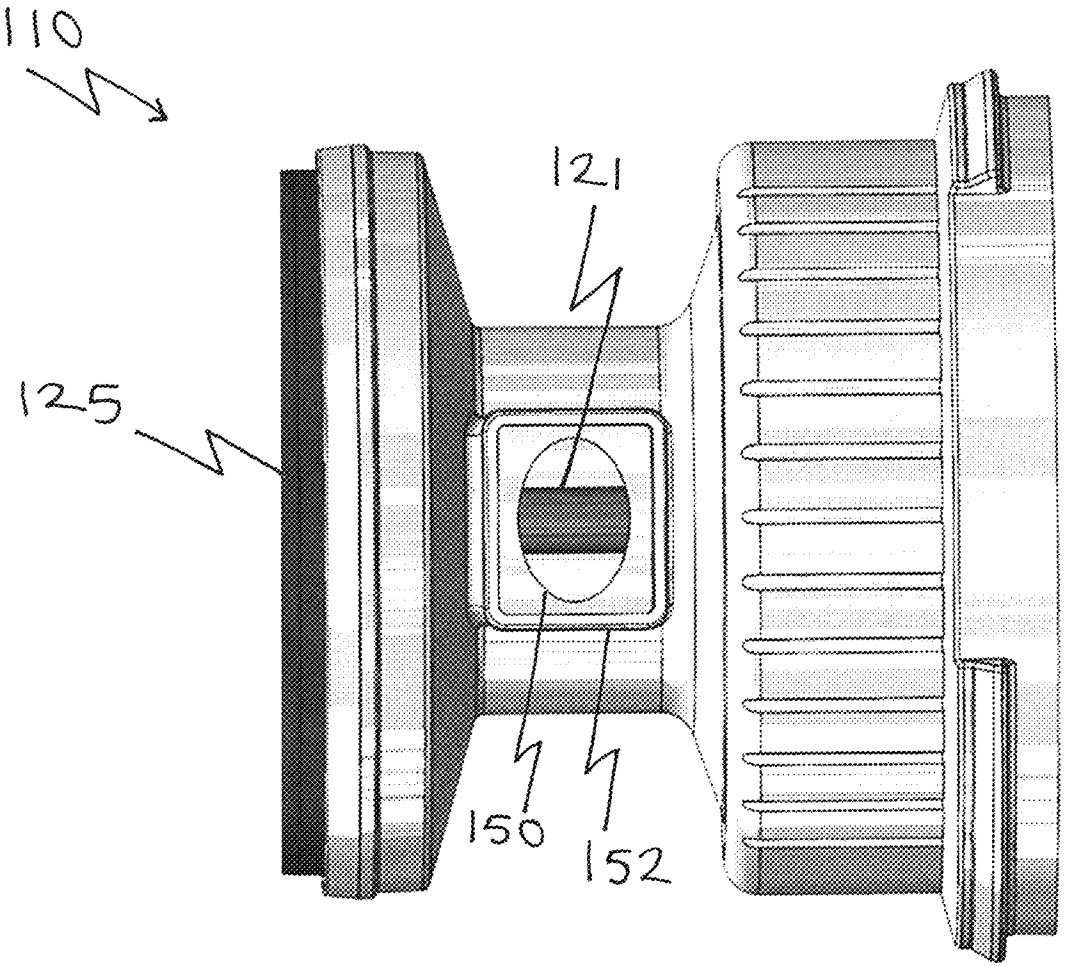
FIG. 3 shows part of a tap according to a further embodiment.

FIG. 3 shows part of a tap 110 formed according to a further embodiment. In this embodiment the button 125 is generally flat. Operation of the tap 110 is otherwise the same as for the tap 10.

Figure 4:
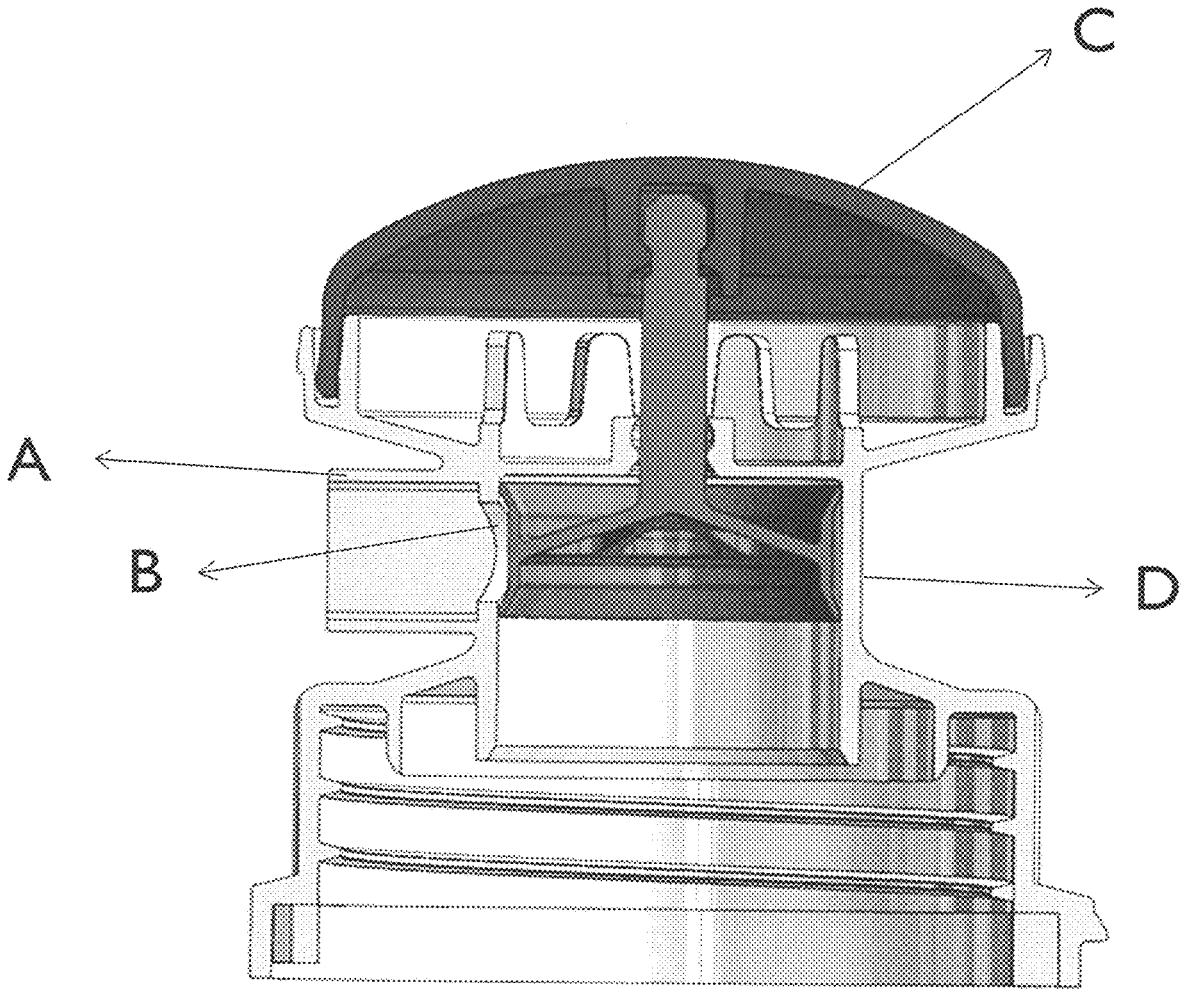
FIGS. 4 to 6 illustrate further features of taps.
Figure 5:
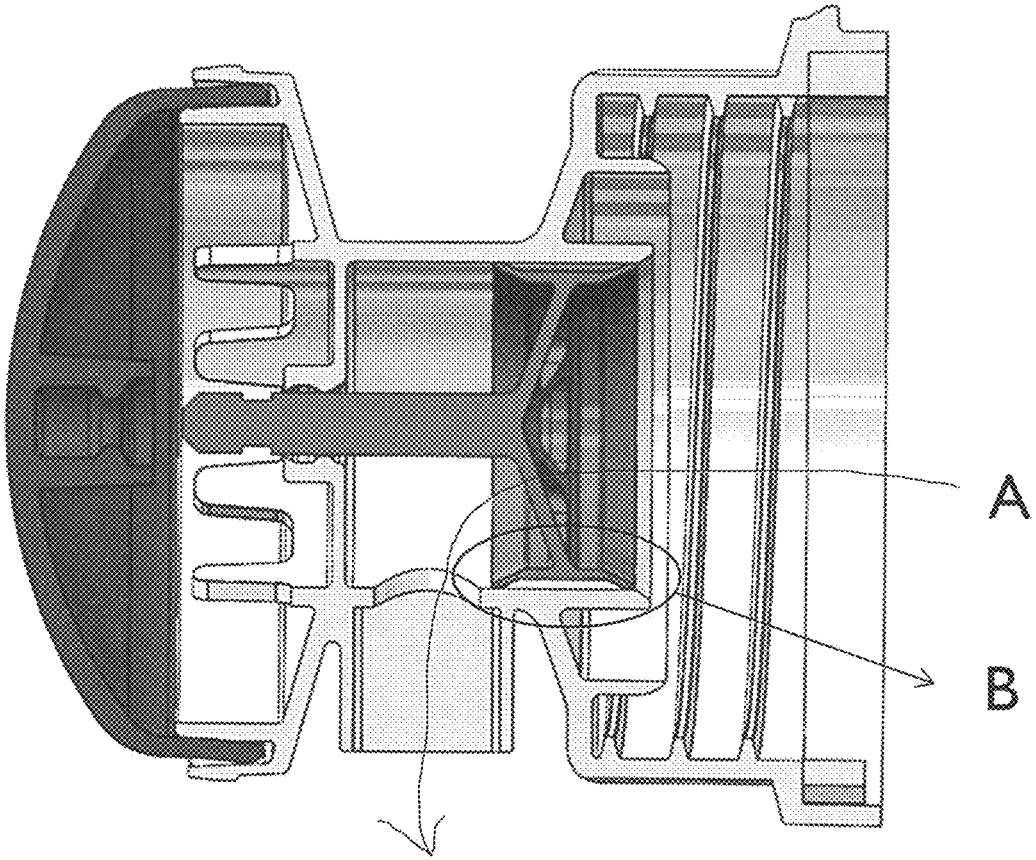
Figure 6:
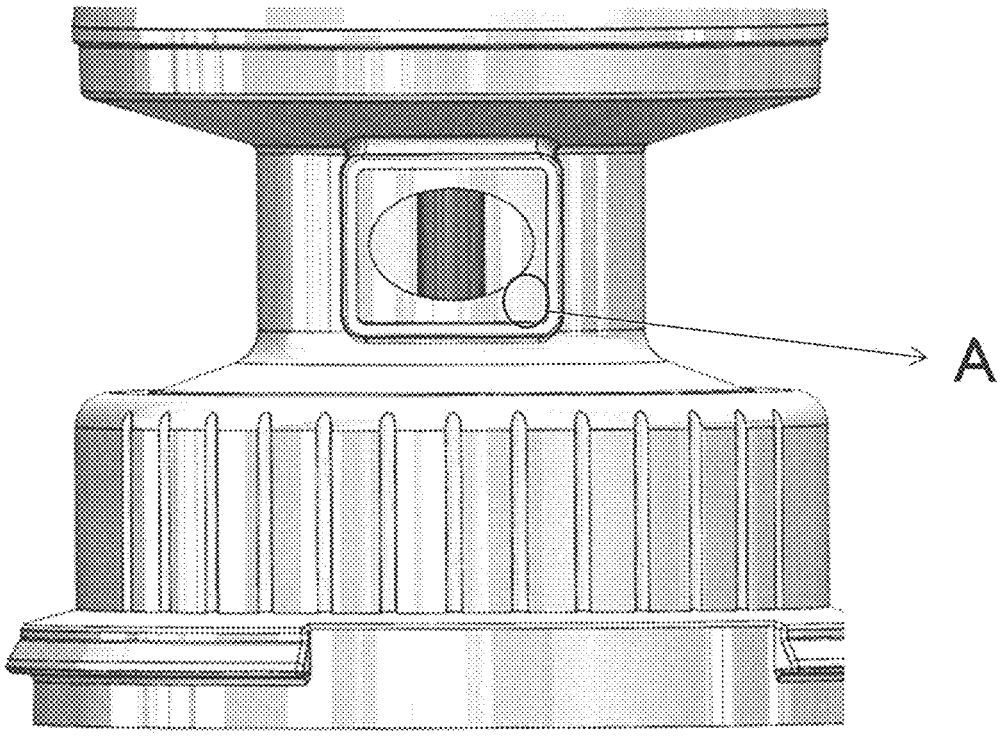

FIGS. 4 to 6 illustrate further features of taps formed in accordance with the present invention.

FIG. 4

Product flows through the windows in the piston into the chamber.

A: Straight product tunnel, helps that no product can stick to the walls; "cosmetic" feature; product comes out from the circular inner orifice.

B: Circular opening within square big opening: problem before: highly viscous products tent to stick to the walls of the outlet tunnel; i.e. creates dipping inter alia since no air can access.

Circular hole can be closed with the piston—cuts off product flow. In addition, air within the square tunnel can get "under" the product when it flows out, thereby helps to cut off the product flow.

C: Flat TPE button may be used: allows more controlled dosing compared to domed shaped/half circle), i.e. more controlled opening/closing of the dosing chamber. Even only half opening is possible.

D: Cylindrical dosing chamber/cylindrical piston: allows dosing of highly viscous products: large amount of product can enter via cylindrical chamber and via the holes in the piston; allows high sealing/emptying of product from the chamber—no remaining product; i.e. avoiding leakage.

FIG. 5

A: Product flows through the piston into the outlet hole.

B: Curved piston helps to sharply cut off the product flow and closes the opening.

FIG. 6

Piston shown in half closed position.

A: Space between circular and square opening creates air reservoir; when product is floating out and the piston is moved in order to close the circular window, no product can stick to the square opening tunnel sidewalls; and thus the air can access the product flow which thereby is cut off more quickly. In addition, due to the curved piston sidewalls further air can get behind the product flow and helps stopping the product flow.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention as defined by the appended claims and their equivalents.

The invention claimed is:

1. A dispensing tap, comprising:

a body which is attached or attachable to a container, the body having a dispensing orifice and a tubular terminal dispensing conduit, and a piston movable within the body between a dispensing position in which flowable product is passable through the dispensing orifice and a sealing position in which the flowable product is not passable through the dispensing orifice, wherein the piston comprises one or more dispensing apertures through which the flowable product is passable when the piston is in the dispensing position to reach the dispensing orifice, wherein the dispensing conduit extends beyond the dispensing orifice, the dispensing orifice having a first cross-sectional shape and the dispensing conduit having a second cross-sectional shape, the first and second shapes being different from each other, and wherein the dispensing orifice is coaxially aligned within the dispensing conduit.

2. A tap as claimed in claim 1, further comprising a press button for moving the piston between the dispensing and sealing positions.

3. A tap as claimed in claim 2, wherein, in the sealing position, the button is generally dome-shape.

4. A tap as claimed in claim 2, wherein, in the sealing position, the button is generally flat.

5. A tap as claimed in claim 2, wherein the button comprises a TPE material.

6. A tap as claimed in claim 1, wherein the piston comprises a stem and a cylindrical sealing wall.

7. A tap as claimed in claim 6, wherein said one or more dispensing apertures comprises a plurality of dispensing apertures, the piston further comprises a plurality of spokes, and the stem is joined to the wall by the plurality of spokes, said plurality of spokes defining the plurality of dispensing apertures therebetween.

8. A tap as claimed in claim 1, wherein the dispensing orifice is centrally positioned relative to the dispensing conduit.

9. A continuous flow press tap, comprising:

a body which is attached or attachable to a container, the body having a dispensing orifice, a mobile piston movable within the body between a first position in which product is passable through the dispensing orifice and a second position in which the product is not passable through the dispensing orifice, and a tubular terminal dispensing conduit extends beyond the dispensing orifice, the dispensing orifice having a first cross-sectional shape and the dispensing conduit having a second cross-sectional shape, the first and second shapes being different from each other, wherein the dispensing orifice is coaxially aligned within the dispensing conduit.

10. A tap as claimed in claim 9, wherein the first shape is selected from the group consisting of: circular, square, oval, ellipsoidal, triangular and polygonal.

11. A tap as claimed in claim 9, wherein the second shape is selected from the group consisting of: circular, square, oval, ellipsoidal, triangular and polygonal.

12. A tap as claimed in claim 9, wherein the first shape is generally ellipsoidal and the second shape is generally square.

13. A dispensing pack, comprising:

a container filled with a flowable product, and a dispensing tap attached to the container for controlling flow of the flowable product out of the container, wherein the flowable product has a viscosity in the range 4.000-6.000 cps at 0.05 $s^1$, the dispensing tap comprising:

a body which is attached to the container, the body having a dispensing orifice and a tubular terminal dispensing conduit, and a piston movable within the body between a dispensing position in which the flowable product is passable through the dispensing orifice and a sealing position in which the flowable product is not passable through the dispensing orifice, wherein the piston comprises one or more dispensing apertures through which the flowable product is passable when the piston is in the dispensing position to reach the dispensing orifice, wherein the dispensing conduit extends beyond the dispensing orifice, the dispensing orifice having a first cross-sectional shape and the dispensing conduit having a second cross-sectional shape, the first and second shapes being different from each other, and wherein the dispensing orifice is coaxially aligned within the dispensing conduit.

14. A pack as claimed in claim 13, wherein the flowable product is a laundry care product.

15. A dispenser, comprising:

a body which is attached or attachable to a container, the body comprising:

a dispensing orifice through which flowable product from the container is to be dispensed in use, and a product tunnel through which the flowable product is passable to reach the dispensing orifice, a mobile piston movable within the flowable product tunnel along a path having a piston movement axis between a first position in which the flowable product is flowable through the dispensing orifice in a direction generally orthogonal to the piston movement axis, and a second position in which the flowable product is not flowable through the dispensing orifice, and a resilient push button for moving the piston from the second position to the first position, the button being biased to keep the piston in the second position and depressable to move the piston to the first position, wherein the piston comprises one or more dispensing apertures through which the flowable product is passable when the piston is in the first position to reach the dispensing orifice, wherein the dispenser further comprises a tubular terminal dispensing conduit that extends beyond the dispensing orifice, the dispensing orifice having a first cross-sectional shape and the dispensing conduit having a second cross-sectional shape, the first and second shapes being different from each other, and wherein the dispensing orifice is coaxially aligned within the dispensing conduit.

16. A dispenser as claimed in claim 15, wherein the product tunnel is generally cylindrical.

17. A dispenser as claimed in claim 15, wherein the product tunnel is generally straight.

18. A dispenser as claimed in claim 15, wherein the product tunnel has a generally circular section.

19. A dispenser as claimed in claim 15, wherein the body is formed as a first part, the piston is formed as a second part and the button is formed as a third part.

20. A dispenser as claimed in claim 15, wherein the body includes a base provided with a screw thread formation.

21. A dispenser as claimed in claim 15, wherein the tubular terminal dispensing conduit is oriented approximately orthogonally to the product tunnel.

* * * * *